US011440631B2

(12) United States Patent
Suzuki et al.

(10) Patent No.: US 11,440,631 B2
(45) Date of Patent: Sep. 13, 2022

(54) BOAT

(71) Applicant: YAMAHA HATSUDOKI KABUSHIKI KAISHA, Iwata (JP)

(72) Inventors: Masaru Suzuki, Shizuoka (JP); Tomohiro Suzuki, Shizuoka (JP); Sho Kakuta, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 30 days.

(21) Appl. No.: 17/148,649

(22) Filed: Jan. 14, 2021

(65) Prior Publication Data

US 2021/0221481 A1 Jul. 22, 2021

(30) Foreign Application Priority Data

Jan. 22, 2020 (JP) ..... JP2020-008565

(51) Int. Cl.
*B63B 49/00* (2006.01)
*B63H 25/02* (2006.01)
*B63B 34/10* (2020.01)

(52) U.S. Cl.
CPC ..... *B63B 49/00* (2013.01); *B63B 34/10* (2020.02); *B63H 25/02* (2013.01); *B63H 2025/024* (2013.01)

(58) Field of Classification Search
CPC ..... B63B 49/00; B63B 34/10; B63H 25/02; B63H 2025/024
See application file for complete search history.

(56) References Cited

U.S. PATENT DOCUMENTS 3,826,220 A * 7/1974 Jacobson ..... B63B 34/10 114/55.52
4,733,627 A * 3/1988 Nishida ..... B63B 34/10 114/55.52
4,989,532 A * 2/1991 Kishi ..... B63B 34/10 114/144 R
5,062,377 A * 11/1991 Miller ..... B63B 34/10 114/144 R
5,103,754 A * 4/1992 Fujitsubo ..... B63B 34/10 188/316
5,282,437 A * 2/1994 Avillez de Basto .... B63B 7/082 114/55.54
5,377,609 A * 1/1995 Miller ..... B63B 34/10 114/144 R
5,390,622 A * 2/1995 Kishi ..... B63B 34/10 114/357
5,490,474 A * 2/1996 Ikeda ..... B63B 34/10 440/89 R (Continued)

FOREIGN PATENT DOCUMENTS

JP 2006069464 A * 3/2006
JP 2013-086668 A 5/2013
JP 2017-087780 A 5/2017

*Primary Examiner* — S. Joseph Morano
*Assistant Examiner* — Jovon E Hayes
(74) *Attorney, Agent, or Firm* — Keating and Bennett, LLP

(57) ABSTRACT

A boat includes a hull, a deck, a steering pole, and an information display. An engine is provided in the hull. The deck is mounted on an upper portion of the hull. The steering pole is swingably mounted to the deck via a pivot shaft. The information display is located on the deck in front of the pivot shaft.

9 Claims, 7 Drawing Sheets

(56) References Cited

U.S. PATENT DOCUMENTS

| | | | | |
|---|---|---|---|---|
| 6,055,922 | A * | 5/2000 | Madachi | B63H 21/213 114/144 R |
| 6,276,291 | B1 * | 8/2001 | Lapointe | B63H 25/00 280/775 |
| 6,308,650 | B1 * | 10/2001 | Tsumiyama | B63B 19/14 49/248 |
| 7,140,314 | B2 * | 11/2006 | Kamio | B63B 34/10 440/2 |
| 7,343,869 | B2 * | 3/2008 | Futaki | B63B 19/14 114/55.56 |
| 7,357,090 | B2 * | 4/2008 | Spade | B63H 25/00 114/55.52 |
| 7,647,143 | B2 * | 1/2010 | Ito | F02D 31/002 440/2 |
| 8,656,852 | B1 * | 2/2014 | Jones | B63H 25/02 114/144 R |
| 9,623,943 | B2 * | 4/2017 | Anma | B63B 34/10 |
| 11,001,349 | B1 * | 5/2021 | Hisada | B63B 34/10 |
| 2005/0235894 | A1 * | 10/2005 | Hattori | B63B 34/10 114/144 R |
| 2005/0247247 | A1 * | 11/2005 | Kamio | B63B 34/10 114/55.56 |
| 2013/0102206 | A1 * | 4/2013 | Fujino | B63H 25/04 440/1 |
| 2017/0121005 | A1 * | 5/2017 | Araki | B63J 2/06 |
| 2021/0221481 | A1 * | 7/2021 | Suzuki | B63H 25/02 |

* cited by examiner

BOAT

CROSS REFERENCE TO RELATED APPLICATIONS

This application claims the benefit of priority to Japanese Patent Application No. 2020-008565 filed on Jan. 22, 2020. The entire contents of this application are hereby incorporated herein by reference.

BACKGROUND OF THE INVENTION

1. Field of the Invention

The present invention relates to boats.

2. Description of the Related Art

As a prior art, a boat, in which an operation portion is swingably mounted to a boat body, is disclosed (see Japanese Patent Publication No. 2017-87780). Also, a boat, in which an information display portion for displaying various information is provided on a handle of the operation portion, is disclosed (see Japanese Patent Publication No. 2013-86668).

In a conventional boat, for example, a stand-ride type small jet propulsion boat, the information display portion is provided on a handle of a tiltable operation portion. In this type of boat, for example, when a driver confirms information of the information display portion of the handle in a state where the driver is directing his/her sight line in a travel direction during navigation, a moving amount of the driver's sight line increases.

Also, in this type of boat, when the operation portion swings with respect to the boat body in a state where the information display portion is provided on the handle, it becomes more difficult for the driver to confirm the information of the information display portion during the navigation.

SUMMARY OF THE INVENTION

Preferred embodiments of the present invention provide boats in each of which a driver is able to easily confirm information during navigation.

A boat according to a preferred embodiment of the present invention includes a hull, a deck, a tiltable operator, and an information display. An engine is located in the hull. The deck is mounted on an upper portion of the hull. The tiltable operator is swingably mounted to the deck via a pivot shaft. The information display is located on the deck in front of the pivot shaft.

According to preferred embodiments of the present invention, a driver is able to easily confirm information during navigation of a boat.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
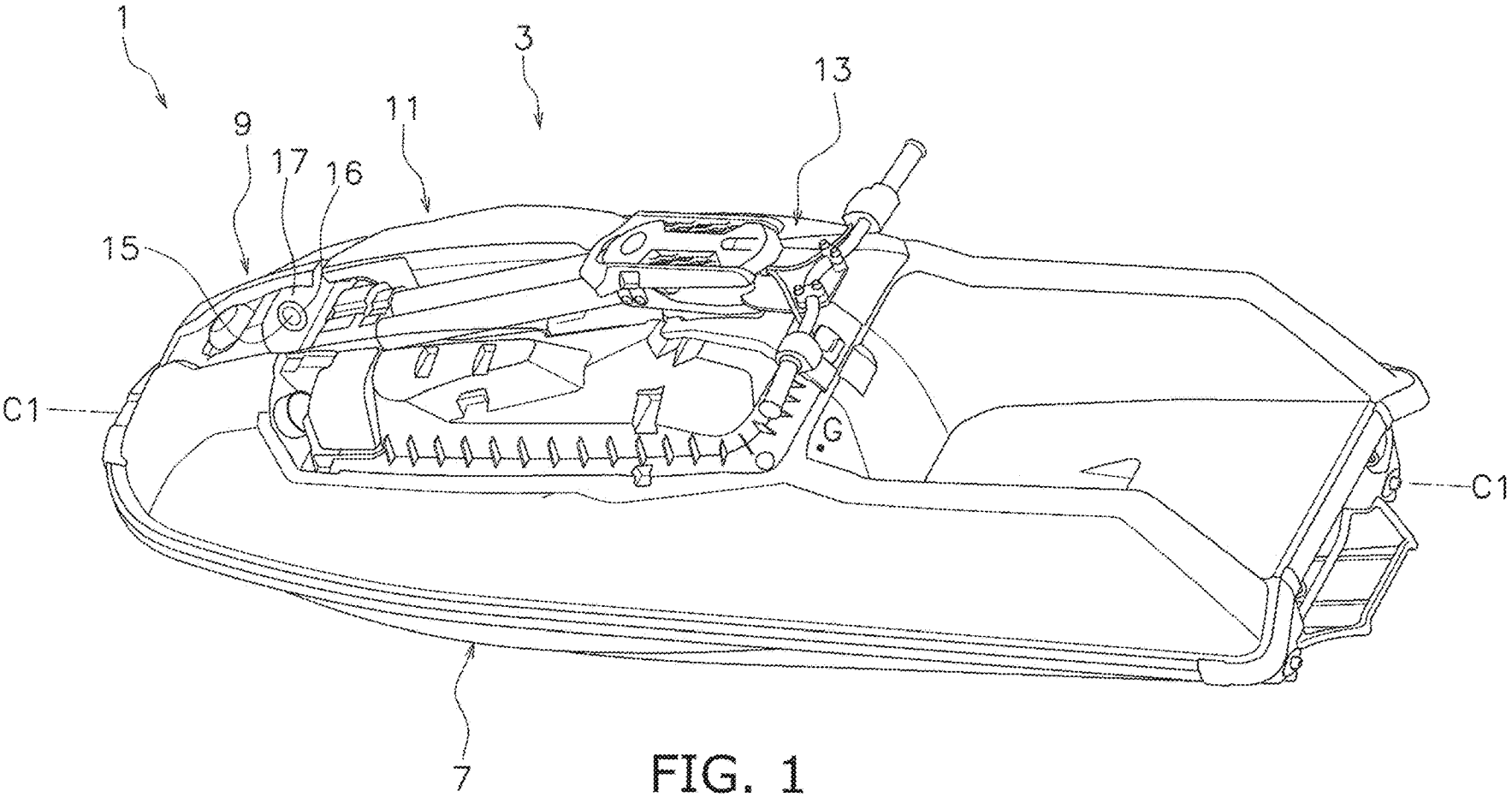
FIG. 1 is a perspective view of a boat according to a preferred embodiment of the present invention.

Hereinafter, preferred embodiments will be described with reference to the drawings. In the following description, the front, rear, left, right, up, and down directions refer to the front, rear, left, right, up, and down directions of the boat 1, respectively. For example, a boat center line Cl extending in the front-rear direction of the boat 1 passes through the center G of gravity of a boat body 3. FIG. 1 shows a state where a left cover portion 21 is removed.

The front-rear direction is a direction along the boat center line Cl. The front direction is a direction toward a left side along the boat center line Cl of FIG. 1. For example, the front direction is a direction in which the boat 1 moves forward. The rear direction is a direction toward a right side along the boat center line Cl in FIG. 1. For example, the rear direction is a direction opposite to a direction in which the boat 1 moves forward.

The left-right direction (a width direction) is a direction perpendicular to the boat center line Cl. The left direction is a direction toward a lower side perpendicular to the boat center line Cl in FIG. 1. The right direction is a direction toward an upper side perpendicular to the boat center line Cl in FIG. 1. The vertical direction is a direction perpendicular to the front-rear direction and the left-right direction.

"In a top view of boat body 3" means "when the boat body 3 is viewed from an upper side". "In a side view of boat body 3" means "when the boat body 3 is viewed from a side". "In a front view of boat body 3" means "when the boat body 3 is viewed from a front side". "In a rear view of boat body 3" means "when the boat body 3 is viewed from a rear side".

As shown in FIG. 1, the boat 1 is a stand-ride type small jet propulsion boat. The boat 1 includes the boat body 3 and an engine 5 (see FIG. 2). The engine 5 is a power source to propel the boat body 3.

The boat body 3 includes a hull 7, a deck 9, a bow hatch 11, a steering pole 13 (an example of a tiltable operator), and an information display 15. The boat body 3 further includes a water stopper 16 disposed between the information display portion 15 and the deck 9.

Figure 2:
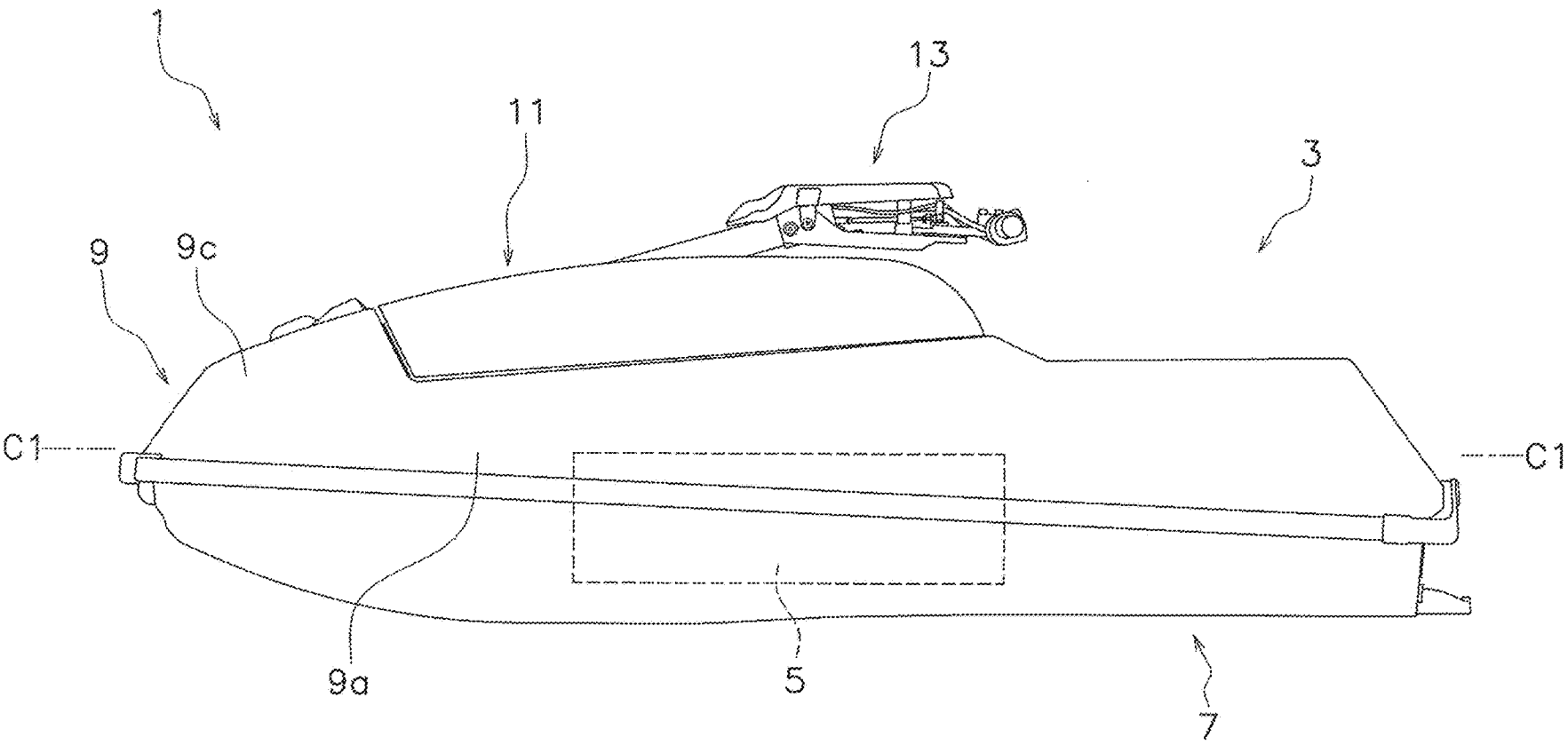
FIG. 2 is a side view of the boat.

The hull 7 defines the bottom of the boat body 3. The hull 7 has a concave shape. As shown in FIG. 2, the engine 5 is located in the hull 7.

Figure 3:
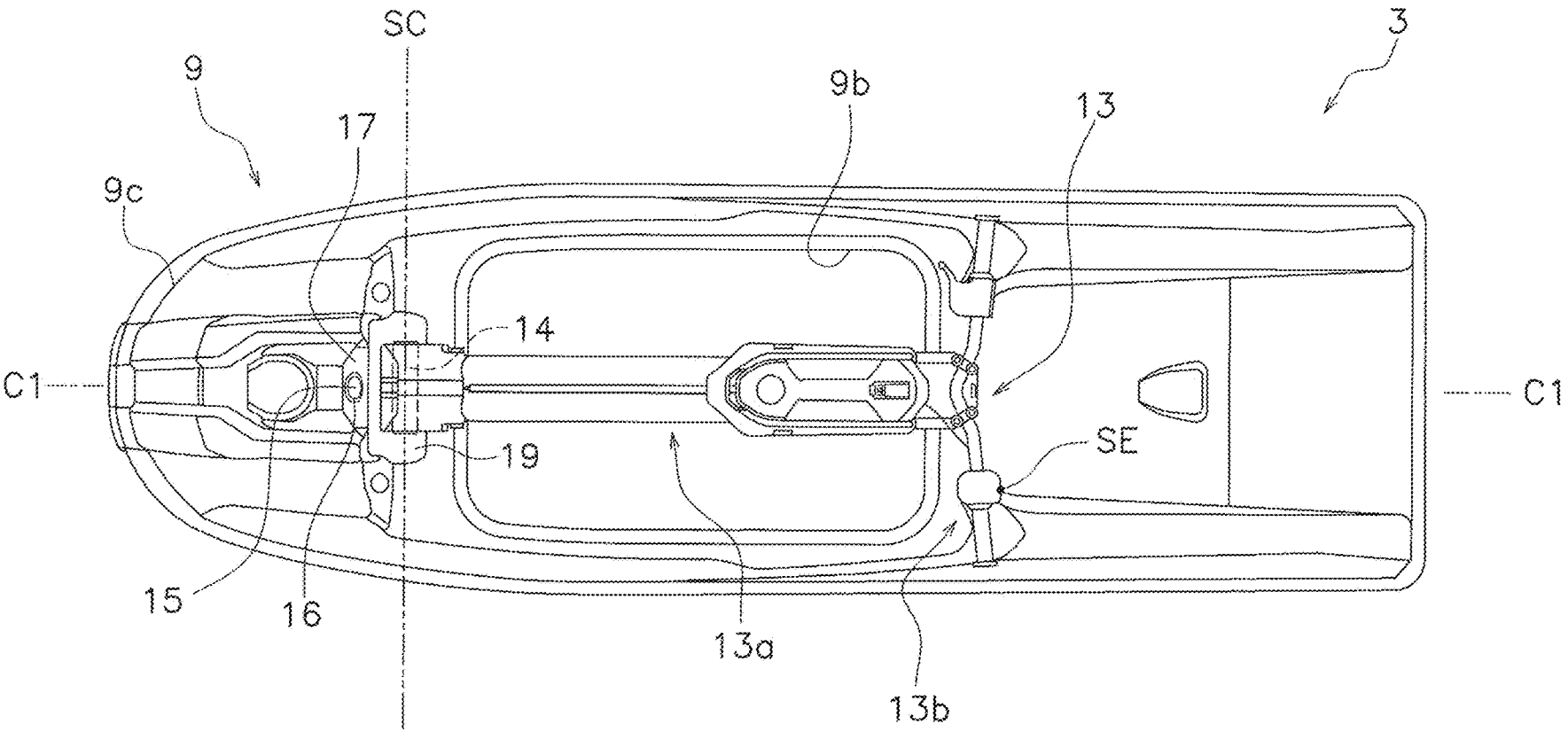
FIG. 3 is a top view of the boat in a state where a bow hatch is removed.

As shown in FIGS. 1 to 3, the deck 9 is mounted on an upper portion of the hull 7. The deck 9 includes a deck body 9*a*, an opening 9*b* (see FIG. 3), and a bulging portion 9*c*. The deck 9 further includes an inclined surface 17 (see FIGS. 1 and 3) and a hole 18 (see FIG. 4). The opening 9*b* is provided on the deck body 9*a*. The bow hatch 11 is located over the opening 9*b*.

As shown in FIGS. 1 to 3, the bulging portion 9*c* bulges from the deck body 9*a*. For example, as shown in FIG. 3, the bulging portion 9*c* is adjacent to the opening 9*b*. Specifically, the bulging portion 9*c* is located on the deck body 9*a* in front of a pivot shaft 14.

The inclined surface 17 includes the information display 15. As shown in FIG. 3, the inclined surface 17 is provided on the deck 9 in front of the pivot shaft 14. For example, the inclined surface 17 is provided on the bulging portion 9*c*. Specifically, the inclined surface 17 is provided on the bulging portion 9*c* in front of the pivot shaft 14. The inclined surface 17 is provided on a rear surface of the bulging portion 9*c*.

Figure 4:
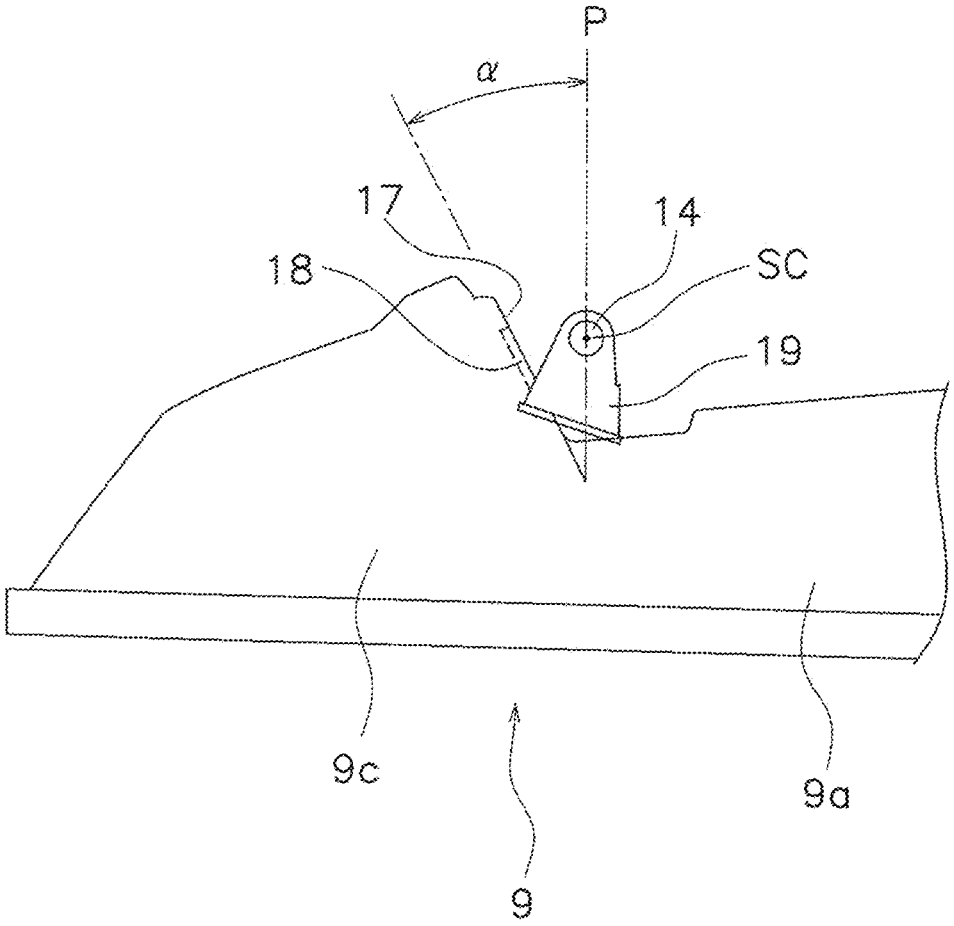
FIG. 4 is a side view for explaining an inclination angle of an inclined surface.

The inclined surface 17 is preferably configured as follows in a state in which the boat body 3 is stationary on a water surface. As shown in FIG. 4, the inclined surface 17 is inclined at an angle α, which is defined by the inclined surface 17 and a plane P including an axial center SC of the pivot shaft 14 and extending in the direction in which gravity acts, that is equal to or larger than 0 degrees and equal to or less than 60 degrees. By providing the inclined surface 17 in this manner, a driver is able to easily confirm the information on the information display 15.

As shown in FIG. 4, the hole 18 is provided on the inclined surface 17. The information display 15 is located in the hole 18. Specifically, the information display 15 is located in the hole 18 via the water stopper 16.

As shown in FIGS. 1 and 2, the bow hatch 11 is connected to the deck 9. The bow hatch 11 is detachably mounted to the deck 9. The bow hatch 11 is located on the deck body 9*a* so as to cover the opening 9*b* (see FIG. 3) of the deck 9. The bow hatch 11 faces the bulging portion 9*c* of the deck 9.

As shown in FIG. 3, an attachment member 19 to attach the steering pole 13 to the deck 9 is located between the bow hatch 11 and the deck 9. The attachment member 19 is fixed to the deck 9. The upper surface of the bow hatch 11 has a concave shape to accommodate the steering pole 13.

As shown in FIGS. 1 and 3, the steering pole 13 is supported by the pivot shaft 14 so as to be swingable with respect to the pivot shaft 14. The steering pole 13 is swingably mounted to the deck 9 via the pivot shaft 14.

As shown in FIG. 3, the steering pole 13 includes a pole 13*a* and a handle 13*b*. The pole 13*a* is supported by the pivot shaft 14 so as to be swingable with respect to the pivot shaft 14. The handle 13*b* is fixed to the pole 13*a*.

The pivot shaft 14 is mounted to the deck 9. For example, the pivot shaft 14 is mounted to the deck 9 via the attachment member 19. Specifically, the pivot shaft 14 is supported by the attachment member 19. The attachment member 19 is fixed to the deck body 9*a* and the bulging portion 9*c*. The pivot shaft 14 extends in a direction perpendicular or substantially perpendicular to the boat center line Cl in the top view of the boat body 3. For example, the pivot shaft 14 extends in the left-right direction.

Figure 5:
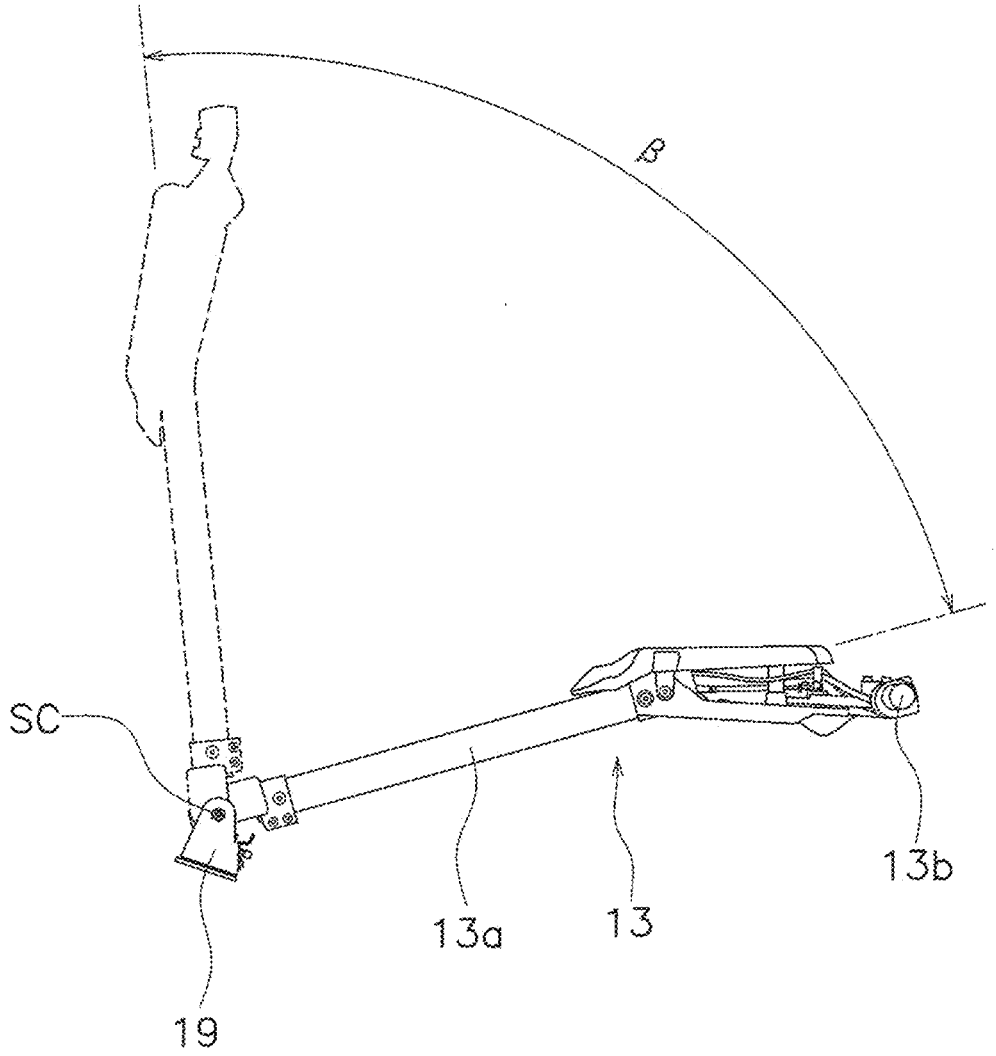
FIG. 5 is a side view for explaining a swing range of a steering pole.

The steering pole 13 is preferably mounted to the deck 9 as follows. For example, as shown in FIG. 5, the steering pole 13 is swingably mounted on the deck 9 so that the swing angle β of the steering pole 13 is equal to or larger than 0 degrees and equal to or less than 80 degrees. In FIG. 5, the swing angle β of the steering pole 13 is defined by a straight line passing through the axial center SC of the pivot shaft 14 and the outermost end SE of the steering pole 13.

The swing angle β is 0 degrees in a state where the steering pole 13 is positioned on the bow hatch 11. A state in which the swing angle β is 0 degrees corresponds to a state in which the steering pole 13 is closest to the bow hatch 11.

By configuring the steering pole 13 in this manner, the driver is able to suitably confirm the information on the information display 15, even if the steering pole 13 is operated during navigation of the boat 1.

The information display 15 displays information about the boat 1. For example, the information display 15 displays the remaining fuel amount, an oil pressure warning, an engine warning, and the like. As shown in FIG. 3, the information display 15 is located on the deck 9 in front of the pivot shaft 14. For example, the information display 15 is located on the deck 9 in front of the attachment member 19 that supports the pivot shaft 14. The information display 15 is located in an internal space defined by the hull 7 and the deck 9. The information display 15 is mounted to the water stopper 16.

The information display 15 includes a housing 15*a* and an information display surface 15*b*. The housing 15*a* accommodates a controller (not illustrated) to control the display on the information display surface 15*b*. The housing 15*a* is mounted on an inner surface of the deck 9, for example, on the inner surface of the bulging portion 9*c*. For example, the housing 15*a* is mounted on the inner surface of a portion of the inclined surface 17 which is provided on the bulging portion 9*c*. Information is displayed on the information display surface 15*b*. The information display surface 15*b* is mounted on the housing 15*a*. The information display surface 15*b* is located on an inner peripheral portion of the water stopper 16.

Figure 7:
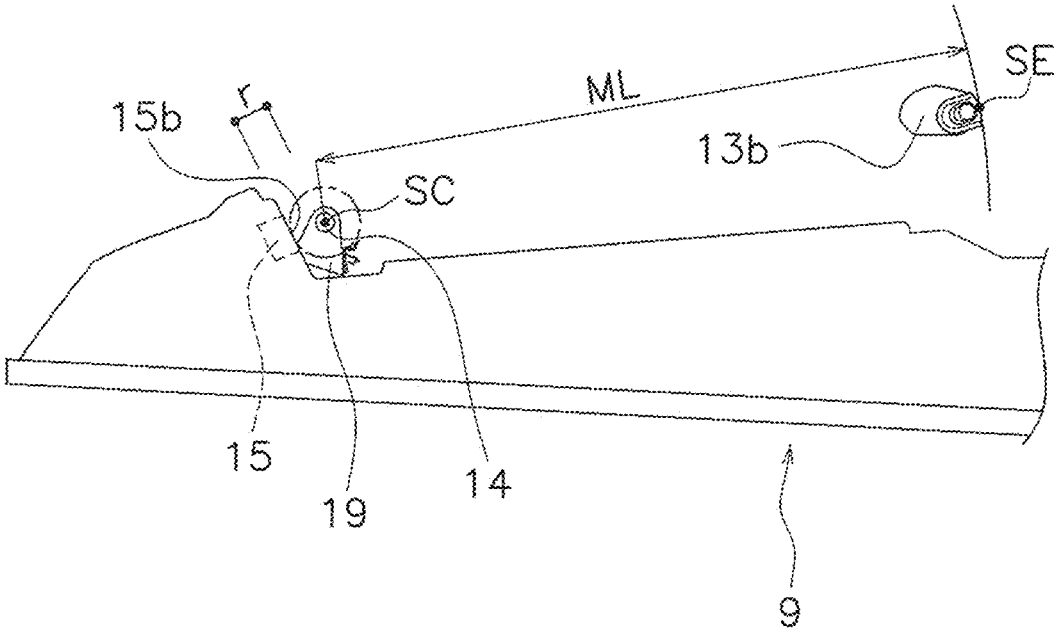
FIG. 7 is a side view for explaining the arrangement of an information display.

The information display 15 including the above configuration is preferably provided on the deck 9 as follows. For example, as shown in FIG. 7, the information display 15 (the information display surface 15*b*) is provided on the deck 9 such that a ratio RT (=r/ML) of a radius r of a circle around the axial center SC of the pivot shaft 14 as seen in a side view of the boat body 3 (deck 9) to a maximum length ML from the axial center SC of the pivot shaft 14 to an outermost end SE of the steering pole 13 is equal to or larger than about 0.05 and equal to or less than about 0.30. By configuring the information display 15 in this manner, the driver is able to easily confirm the information on the information display 15 during navigation of the boat 1.

Figure 6:
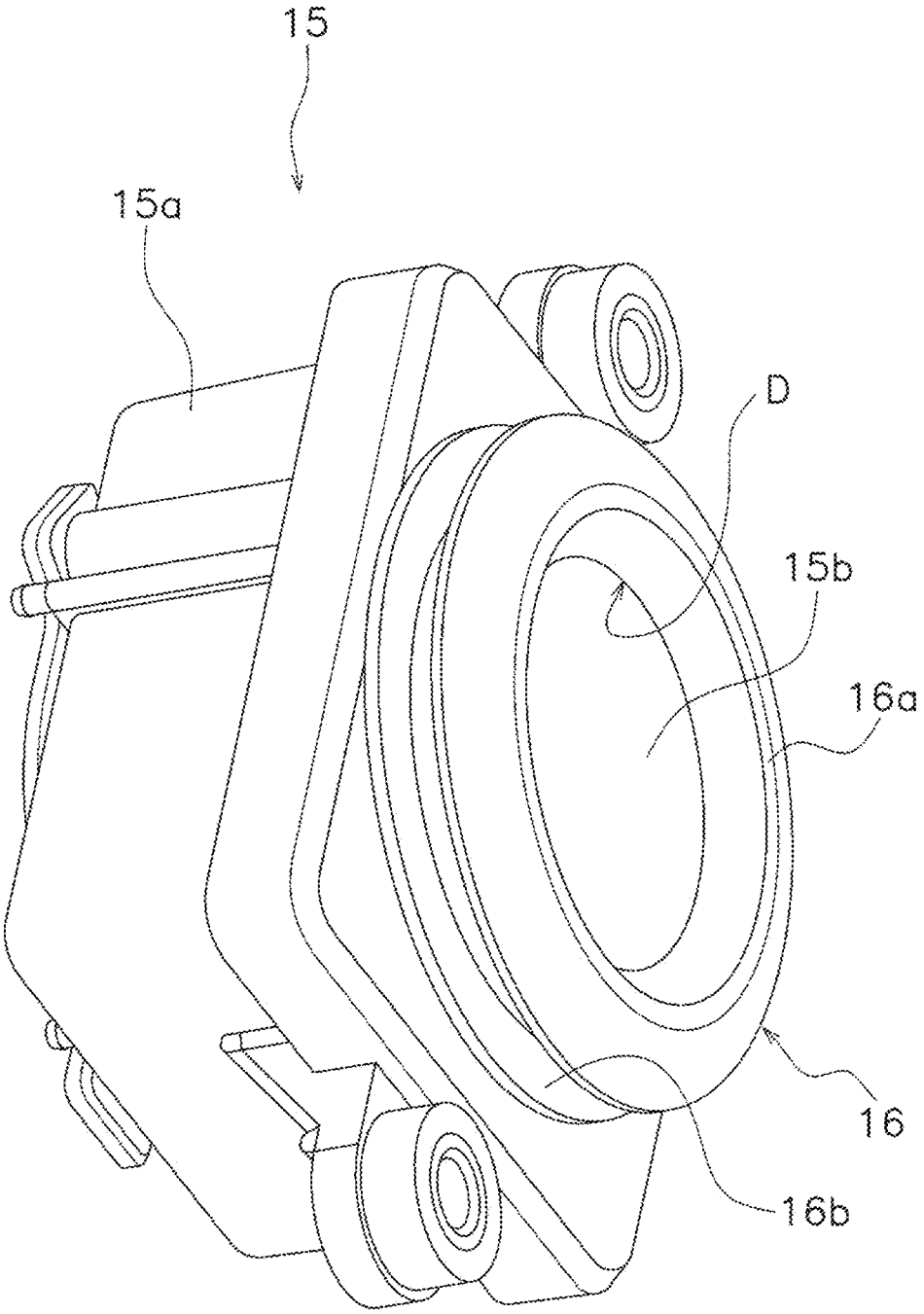
FIG. 6 is a perspective view for explaining the configuration of an information display and a water stopper.

The water stopper 16 is provided to stop water from passing between the information display 15 and the hole 18. The water stopper 16 is located between the information display 15 and the hole 18. As shown in FIG. 6, the water stopper 16 includes a main body 16*a* and a groove 16*b*.

The main body 16*a* is mounted to the information display 15. For example, the main body 16*a* is mounted to the housing 15*a*. The main body 16*a* has an annular shape, for example. The information display surface 15*b* is located on the inner peripheral portion of the main body 16*a*.

The groove 16*b* is located on an outer peripheral portion of the main body 16*a*. The groove 16*b* is fitted into the hole 18. In a state where the groove 16*b* is fitted to the hole 18 of the deck 9 (the inclined surface 17), a step D is formed between the information display surface 15*b* and the inner peripheral surface of the main body 16*a*.

Due to this step D, a shadow is provided between the outer peripheral portion of the information display surface 15*b* and the inner peripheral surface of the main body 16*a* so that the visibility of the information displayed on the outer peripheral portion of the information display surface 15*b* is improved. Also, due to this step D, the information display surface 15*b* is protected by the water stopper 16.

According to preferred embodiments of the present invention, a driver is able to easily confirm information during navigation of the boat.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat comprising:

a hull in which an engine is located;

a deck mounted on an upper portion of the hull;

a tiltable operator swingably mounted to the deck via a pivot shaft; and an information display located on the deck in front of the pivot shaft; wherein the deck includes an inclined surface accommodating the information display; and the information display is positioned on the deck such that a ratio of a radius of a circle around an axial center of the pivot shaft and that contacts the inclined surface in a side view to a maximum length from the axial center of the pivot shaft to an outermost end of the tiltable operator is equal to or larger than about 0.05 and equal to or less than about 0.30.

2. The boat according to claim 1, wherein the inclined surface is inclined at an angle, defined by the inclined surface and a plane including an axial center of the pivot shaft and extending in a direction in which gravity acts, that is equal to or larger than about 0 degrees and equal to or less than about 60 degrees.

3. The boat according to claim 1, further comprising:

a bow hatch connected to the deck; wherein a swing angle of the tiltable operator is defined as 0 degrees in a state where the tiltable operator is positioned on the bow hatch; and the tiltable operator is swingably mounted on the deck so that the swing angle of the tiltable operator is equal to or larger than about 0 degrees and equal to or less than about 80 degrees.

4. The boat according to claim 1, further comprising:

a water stopper located between the information display and the deck.

5. The boat according to claim 4, wherein the deck includes a hole;

a groove is provided on an outer periphery of the water stopper; and the groove is fitted to the hole.

6. The boat according to claim 4, wherein the information display is located in an internal space defined by the hull and the deck and is mounted to the water stopper.

7. A boat comprising:

a hull in which an engine is located;

a deck mounted on an upper portion of the hull;

a tiltable operator swingably mounted to the deck via a pivot shaft;

an information display located on the deck in front of the pivot shaft; and a bow hatch connected to the deck; wherein a swing angle of the tiltable operator is defined as 0 degrees in a state where the tiltable operator is positioned on the bow hatch; and the tiltable operator is swingably mounted on the deck so that the swing angle of the tiltable operator is equal to or larger than about 0 degrees and equal to or less than about 80 degrees.

8. A boat comprising:

a hull in which an engine is located;

a deck mounted on an upper portion of the hull;

a tiltable operator swingably mounted to the deck via a pivot shaft;

an information display located on the deck in front of the pivot shaft; and a water stopper located between the information display and the deck.

9. A boat comprising:

a hull in which an engine is located;

a deck mounted on an upper portion of the hull;

a tiltable operator swingably mounted to the deck via a pivot shaft;

an information display located on the deck in front of the pivot shaft; and a bow hatch located behind the pivot shaft and connected to the deck.

* * * * *